US005121803A

United States Patent [19]

Hartmann et al.

[11] Patent Number: 5,121,803

[45] Date of Patent: Jun. 16, 1992

[54] CORDLESS TOOL BIT STORAGE

[75] Inventors: James R. Hartmann, Chicago; Jennifer F. Uzumcu, Hoffman Estates; P. Sean Gallagher, Park Forest, all of Ill.

[73] Assignee: Skil Corporation, Chicago, Ill.

[21] Appl. No.: 742,863

[22] Filed: Aug. 9, 1991

[51] Int. Cl.[5] ..... B25F 1/08

[52] U.S. Cl. ..... 173/171; 81/177.4; 81/490; 408/241 R

[58] Field of Search ..... 173/171; 81/177.4, 490, 81/491; 408/241 R; 279/1 K, 79, 80; 206/373, 349, 372, 379, 493

[56] References Cited

U.S. PATENT DOCUMENTS

| | | | |
|---|---|---|---|
| 373,503 | 11/1887 | Warren | 81/490 |
| 670,361 | 3/1901 | Sather | 81/177.4 |
| 1,105,818 | 8/1914 | Moore | 81/490 |
| 3,426,813 | 2/1969 | Robertson | 81/490 |
| 4,550,476 | 11/1985 | DeCaro | 408/241 R |
| 4,762,036 | 8/1988 | Orlitzky et al. | 81/177.4 |
| 4,932,294 | 6/1990 | Chaung . | |
| 4,954,026 | 9/1990 | Zurwelle . | |
| 4,973,205 | 12/1990 | Spaulding . | |
| 4,983,080 | 1/1991 | Somers et al. | 408/241 R |
| 5,056,661 | 10/1991 | Balzano . | |

*Primary Examiner*—Frank T. Yost
*Assistant Examiner*—Scott A. Smith
*Attorney, Agent, or Firm*—Jones, Day, Reavis & Pogue

[57] ABSTRACT

An improved cordless motor-driven electric hand tool that has an elongated body portion with a tool bit-receiving chamber at one end and a housing at the other end having a battery-receiving chamber therein. An elongated tool bit storage chamber is formed in the housing above and/or below the battery-receiving chamber and has a cover that is pivotally mounted for open and closed positions. The housing is oval shaped to create a space above and/or below the battery-receiving chamber in which the tool bit storage chamber is formed.

6 Claims, 3 Drawing Sheets

CORDLESS TOOL BIT STORAGE

FIELD OF THE INVENTION

The present invention relates to cordless tools in general and in particular to a cordless tool that has a bit storage compartment in the handle thereof for storing a tool bit to be utilized by the tool.

BACKGROUND OF THE INVENTION

Cordless, battery powered tools are well known in the art and are used for a variety of functions such as electric drills, electric screwdrivers, electric jig saws, and the like. In power tools such as electric screwdrivers and electric drills, it is important that the tool or bit to be used by the cordless device be associated with the device for quick access. As used hereafter, the term "tool bit" is intended to mean any type of bit for a battery-powered tool such as drill bits, screwdriver bits, jigsaw blades and the like. In elongated cordless motor-driven electric hand tools such as a screwdriver, it is difficult to store the tool or bit on the device itself since the device is generally cylindrical in shape and has a battery inserted at one end and the bit-receiving device at the other end. In such case, the tool or bit itself, such as a screwdriver having a common screwdriver bit at one end and a phillips or crosspoint screwdriver bit at the other end, is generally stored in a container that is kept separate from the battery-powered tool. Obviously this is a cumbersome situation at best since the powered device must not become separated from the container in which the bit is located. It would be extremely convenient to have a compartment on the battery-powered device or tool itself in which the tool bit could be stored until it is required for use. However, as stated, with the battery pack inserted in one end and the bit-receiving device at the other end and the motor and gear train to drive the bit-receiving end in the center, there is little space left for an enclosure or chamber in which a tool bit can be inserted for storage purposes.

The present invention overcomes the disadvantages of the prior art by providing an elongated cordless motor-driven electric hand tool having an elongated body portion with a tool bit-receiving means at one end and a housing at the other end having a battery-receiving chamber therein. An elongated tool bit-receiving chamber is formed in the housing above the battery-receiving chamber and a cover is provided for the tool bit-receiving chamber that is pivotally mounted to the housing for opening and closing the chamber. The cover has an outer shape that conforms to the outer shape of the housing and matches the outer contour of the housing in the closed position.

In the preferred embodiment, to minimize the size of the tool, the housing is oval shaped to create a space above the battery-receiving chamber and the tool bit-receiving chamber is in the space above the battery-receiving chamber. A pivot point is spaced from one end of the chamber cover for the tool bit-receiving chamber such that a force applied to the cover at the one end causes the other end of the cover to move upwardly from the housing to expose the tool bit-receiving chamber and allow a tool bit to be placed therein and removed therefrom. A resilient spring is placed in the tool bit-receiving chamber and coupled to the cover for returning the cover to its closed position when the applied force is removed. The spring is a leaf spring having one end rigidly coupled to the bottom of the tool bit-receiving chamber under the outer end of the cover and the other end flexibly positioned under and in engagement with the inner end of the cover such that when the inner end of the cover has the force applied downwardly, the spring in engagement therewith is deflected and when the applied force is removed the deflected spring returns to its initial position and closes the cover.

The battery-receiving chamber has an unsymmetrical cross-sectional shape with a flat surface adjacent the tool bit-receiving chamber. It also has an arcuate section opposite the flat surface and adjacent an end of the oval shaped housing. A rechargeable battery pack has an unsymmetrical cross-sectional shape that matches the unsymmetrical cross-sectional shape of the battery-receiving chamber for insertion therein from the one end of the housing. Thus, with the flat spot on the battery adjacent the tool bit-receiving chamber, the most effective use is made of the space in the oval shaped housing.

Thus it is an object of the present invention to provide an improved cordless motor-driven electric hand tool having an elongated body portion with a tool bit-receiving means at one end and a housing at the other having a battery-receiving chamber therein. An elongated tool bit storage chamber is formed in the housing on one side above the battery-receiving chamber and has a cover pivotally mounted to the housing for open and closed positions. The cover has an outer shape conforming to the housing shape for matching the outer contour of the housing in the closed position.

It is another object of the present invention to form the housing portion of the battery powered tool with an oval shape to create a space above and/or below the battery-receiving chamber and placing the tool bit storage chamber in the space above and/or below the battery-receiving chamber.

It is still another object of the present invention to provide a pivot point on the cover of the tool bit storage chamber that is spaced from one end thereof such that a force applied to the cover at the one end causes the other end of the cover to move upwardly from the housing to expose the tool bit storage chamber and allow a tool to be placed therein and removed therefrom.

It is also another object of the present invention to provide a resilient spring coupled to the cover of the tool bit storage chamber for returning the cover to its closed position when the applied force is removed.

It is yet another object of the present invention to provide a battery chamber with an unsymmetrical cross-sectional shape with a flat surface adjacent the tool bit storage chamber to provide additional space for the tool bit storage chamber. An arcuate section is formed on the battery-receiving chamber opposite the flat surface adjacent to the end of the oval shaped housing. The rechargeable battery pack has an unsymmetrical cross-sectional shape that matches the unsymmetrical cross-sectional shape of the battery-receiving chamber for insertion therein.

SUMMARY OF THE INVENTION

Thus the present invention relates to an improved cordless motor-driven electric hand tool that has an elongated body portion with a tool bit-receiving means at one end and a housing at the other end having a battery-receiving chamber therein. An elongated tool bit storage chamber is formed in the housing above and/or below the battery-receiving chamber. A cover for the tool bit storage chamber is pivotally mounted on the housing for open and closed positions and has an outer shape that conforms to the housing shape for matching the outer contour of the housing in the closed position.

In the preferred embodiment the housing is oval shaped to create a space above and/or below the battery-receiving chamber in which the tool bit storage chamber is placed. Further, the battery-receiving chamber has an unsymmetrical cross-sectional shape with a flat surface adjacent the tool bit storage chamber for providing additional space for the tool bit storage chamber. A rechargeable battery pack has an unsymmetrical cross-sectional shape that matches the unsymmetrical cross-sectional shape of the battery-receiving chamber so that it can be inserted therein in only one direction.

BRIEF DESCRIPTION OF THE DRAWINGS

These and other objects of the present invention will be more fully understood in conjunction with a detailed description of the accompanying drawings in which like numbers indicate like components and in which.

DETAILED DESCRIPTION OF THE DRAWINGS

Figure 1:
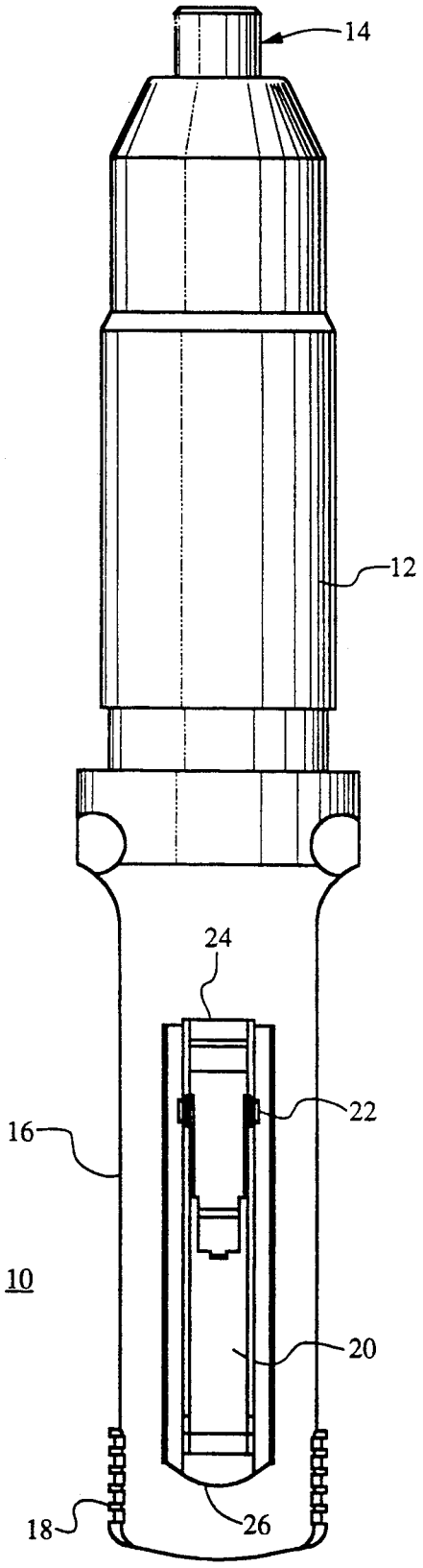
FIG. 1 is a top view of the novel elongated motor-driven electric hand tool.
Figure 2:
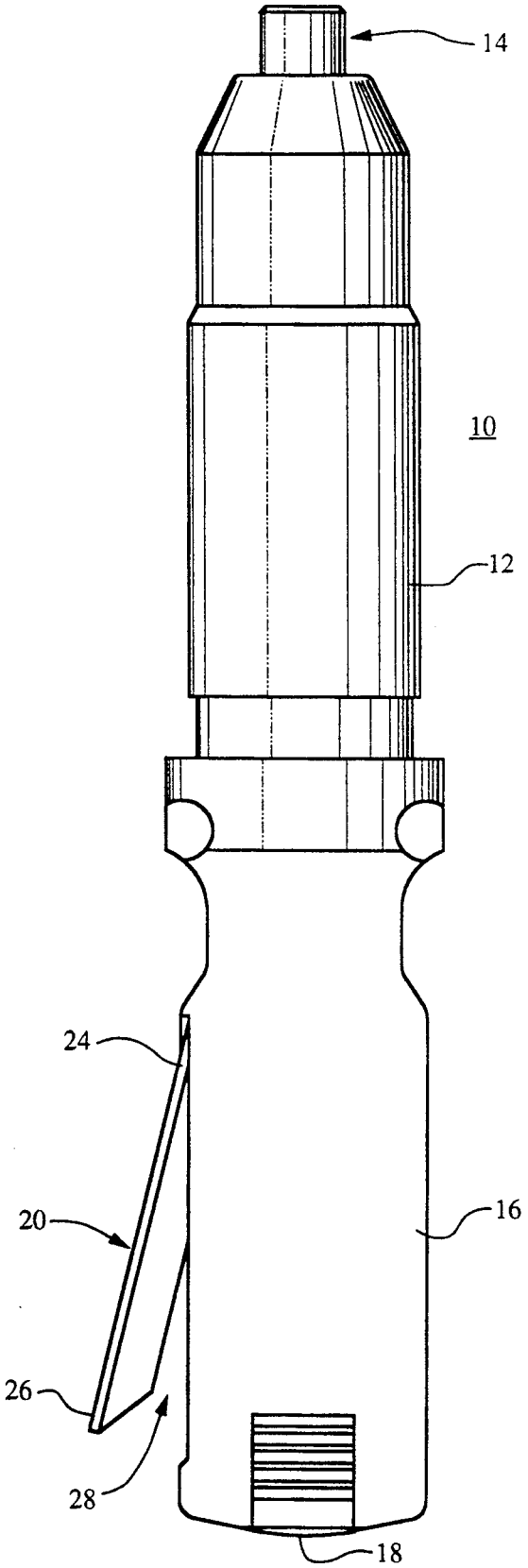
FIG. 2 is a side view of the novel tool with the tool bit storage chamber cover in the open position.
Figure 4A:
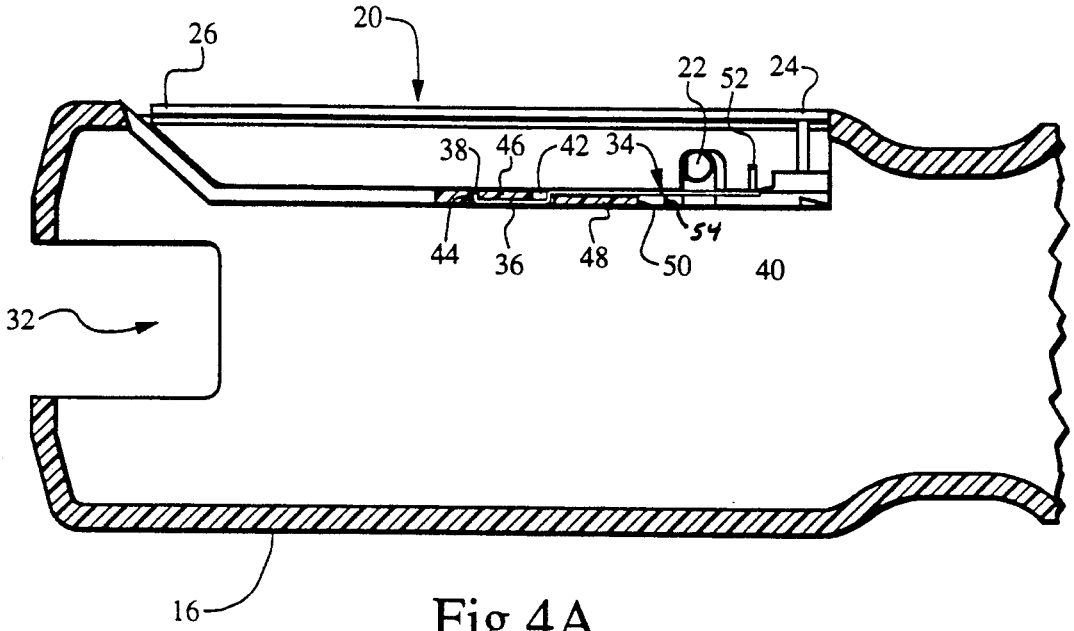
FIG. 4A is an enlarged cross-sectional detail view of the housing portion of the tool in which the battery is inserted and illustrating in detail the cover for the tool bit storage chamber in its closed position and the spring for returning the cover to its closed position when it is opened.
Figure 3:
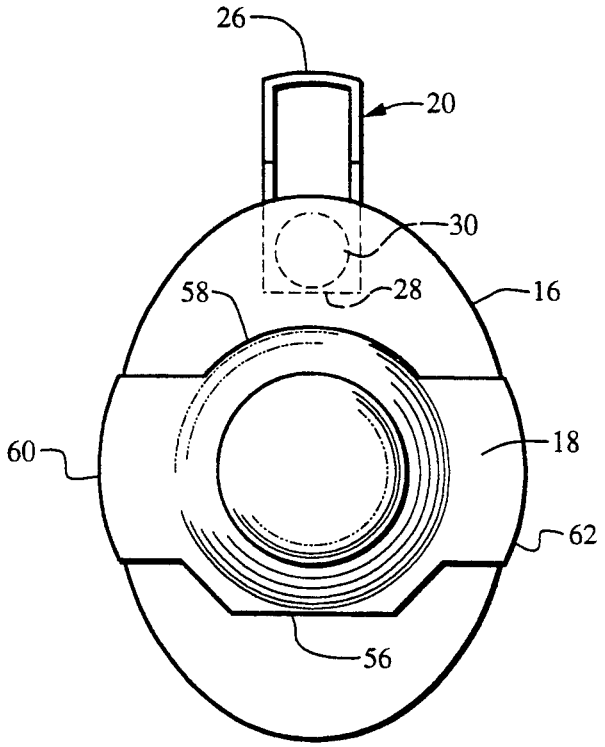
FIG. 3 is an end view of the novel tool from the battery-receiving end illustrating the battery with the flat surface adjacent the tool bit storage chamber and illustrating the cover for the chamber in the open position.

FIG. 1 is a top view of the novel tool 10 of the present invention. It has an elongated body portion 12 with a tool bit-receiving means 14 at one end and a housing 16 at the other end. A battery-receiving chamber 32 (see FIG. 4) is formed in housing 16 for receiving battery 18. An elongated tool bit storage chamber 28, seen best in FIG. 2, is formed in the housing 16 above (but could be below) the battery-receiving chamber 32 in which battery 18 is inserted. A cover 20 for the tool bit storage chamber 28 is pivotally mounted to the housing at pivot point 22 so that the cover 20 can be opened and closed. The cover 20 has an outer shape conforming to and matching the outer contour of the housing 16 when in the closed position, as can be seen in FIG. 5. It will be noted in FIG. 3 that the housing 16 is oval shaped to create a space above the battery-receiving chamber 32 (best shown in FIG. 4) and the tool bit storage chamber 28 is formed in the space above or on one side of the battery-receiving chamber 32. The cover 20 has the pivot point 22 spaced from the one end 24 such that a force applied to the cover at end 24 causes the other end 26 of the cover 20 to move upwardly from the housing 16 to expose the tool bit storage chamber 28 as shown in FIGS. 2 and 4 to allow a tool bit to be placed therein and removed therefrom. A spring 34 is coupled to the cover 20 for returning cover 20 to its closed position when the applied force is removed.

Figure 4B:
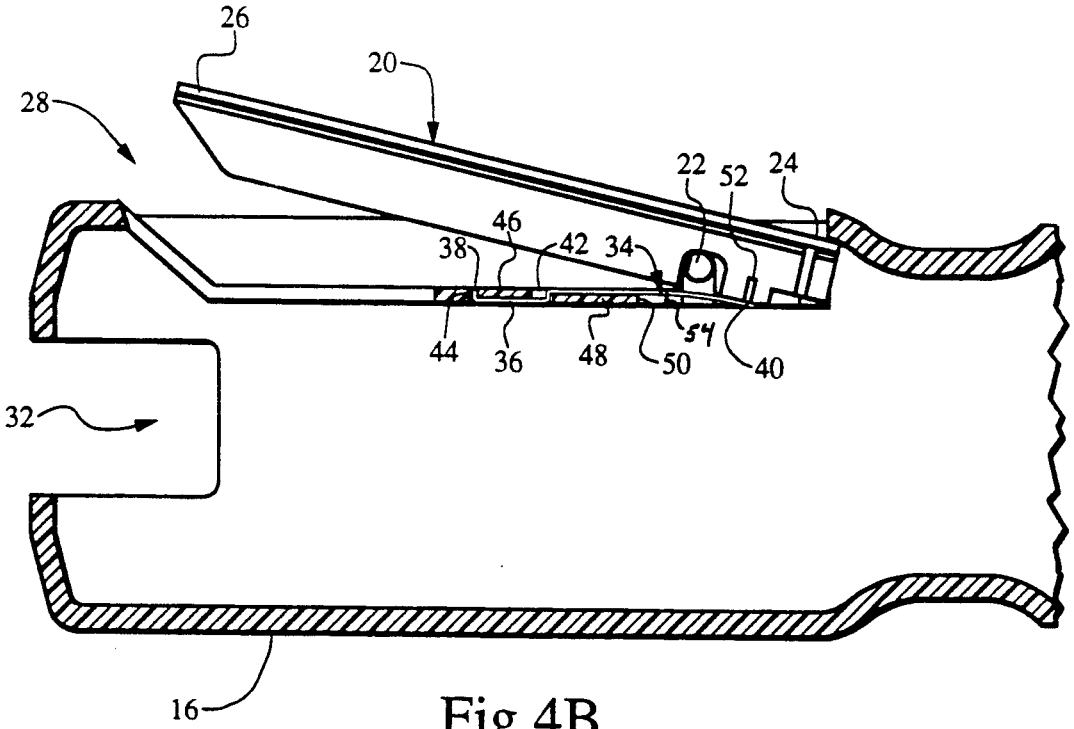
FIG. 4B is an enlarged cross-sectional view of the housing portion of the tool illustrating the cover for the tool bit storage chamber in its open position.
Figure 5:
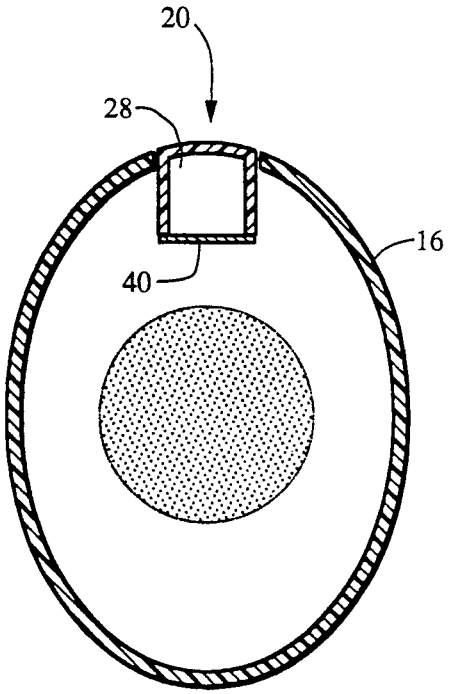
FIG. 5 is a partial cross-sectional view of a portion of the tool bit storage chamber and the cover therefor illustrating the relationship of the cover and the spring which returns the cover to its closed position.

As can be best seen in FIG. 4, a resilient spring 34 is placed in said tool-receiving chamber 28. The outer wall edge on the cover 20 engages the spring 34 at its inner end 40 such that when a force is supplied to the inner end 24 of the cover 20, outer wall edge 52 engages portion 40 of spring 34 and distorts portion 40 by bending it downwardly such that when the applied force is removed, the spring portion 40 returns from its distorted position and forces outer wall edge 52 of inner end 24 of cover 20 upwardly, thus returning the cover 20 to its closed position. As can be seen in FIG. 4, spring 34 is a leaf spring having one end 36 rigidly coupled to the bottom of the tool-receiving chamber 28 under a portion 46 of housing 16 which may be any desired material such as plastic or metal. The spring outer end 36 and outer tip 38 are inserted in slot 42 in a vertical position and then the spring is tipped to the rear, thus causing the outer tip 38 of the outer end portion 36 of the spring to enter slot 44. Thus the positioning portion 36 of the spring 34 lies under a projection 46 on housing 16 and is held rigidly in place. The cover 20 is then engaged in place. When a force is applied to inner end 24 of cover 20 to cause the cover 20 to pivot about pivot point 54, the outer wall edge 52 distorts outer end 40 of spring 34 about the end 50 of housing portion 48 on which the spring is resting. As the spring end 40 moves downwardly, the outer wall edge 52 moves to the position illustrated in FIG. 4B. Thus when the force is removed from inner end 24 of the cover 20, the spring 34 forces outer wall edge 52 and thus inner end 24 of cover 20 upwardly, thus closing the cover 20.

It will be seen that the rechargeable battery pack 18 has an unsymmetrical cross-sectional shape that matches the unsymmetrical cross-sectional shape of the battery-receiving chamber 32 for a close fit therein. The battery 18 may be of the type disclosed in commonly-assigned copending application Ser. No. 743,166 filed Aug. 9, 1991 and entitled "Battery Pack" which is incorporated herein by reference in its entirety. It has latch devices 60 and 62 on the sides thereof for latching the battery 18 inside the battery-receiving chamber 32 in the housing 16.

Thus there has been disclosed a novel improved cordless motor-driven electric hand tool that has an elongated body portion with a tool bit-receiving device at one end and a housing at the other end having a battery-receiving chamber therein. An elongated tool bit storage chamber is formed in the housing above and/or below the battery-receiving chamber and has a cover therefor. The housing is oval shaped to create additional space above and/or below the battery-receiving chamber in which the tool bit storage chamber is formed. The rechargeable battery pack inserted therein has an unsymmetrical cross-sectional shape that matches the unsymmetrical cross-sectional shape of the battery-receiving chamber.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the independent claims.

We claim:

1. An improved cordless motor-driven electric hand tool comprising:

an elongated body portion having a tool bit receiving means at one end and a housing symmetrical in cross-section at the other end and having an unsymmetrical battery-receiving chamber therein;

an elongated tool bit storage chamber formed in said symmetrical housing adjacent said battery-receiving chamber; and a cover for said tool bit storage chamber pivotally mounted to said housing for open and closed positions, said cover having an outer shape conforming to said housing for matching the outer contour of said housing in the closed position, wherein said housing is oval shaped; said battery-receiving chamber extends from side-to-side of the minor axis of said oval shaped housing; and said tool bit storage chamber is formed in one end of the major axis of said oval shaped housing.

2. An improved cordless motor-driven electric hand tool as in claim 1 further comprising:

a pivot point sapced from an end of said cover such that a force applied to said cover at said end spaced from said pivot point causes the other end of said cover to move upward from said housing to expose said tool bit storage chamber and allow a tool bit to be placed therein and removed therefrom; and means coupled to said cover for returning said cover to its closed position when said applied force is removed.

3. An improved cordless motor-driven electric hand tool as in claim 2 wherein said one end of said cover is an inner end and the other end of said cover is an outer end adjacent the outer end of said housing.

4. An improved cordless motor-driven electric hand tool as in claim 3 wherein said cover closing means comprises:

a resilient spring in said tool bit storage chamber; and means in the tool bit storage chamber cover for engaging said spring when said force is applied to distort at least a portion of said spring such that when said applied force is removed, said spring returns from its distorted position and returns the cover to its closed position.

5. An improved cordless motor-driven electric hand tool as in claim 3 wherein said spring is a leaf spring having one end rigidly coupled to the bottom of the tool bit-receiving chamber under the outer end of the cover and the other end flexibly positioned under and in engagement with said inner end of said cover such that when said inner end of said cover has said force applied, said engaged end of said spring is deflected and when said applied force is removed, said deflected spring returns to its initial position and closes said cover.

6. An improved cordless motor-driven electric hand tool as in claim 5 further including a rechargeable battery pack having an unsymmetrical cross-sectional shape that matches the unsymmetrical cross-sectional shape of the battery-receiving chamber for insertion therein.

* * * * *